US011608803B2

(12) United States Patent
Heher et al.

(10) Patent No.: US 11,608,803 B2
(45) Date of Patent: Mar. 21, 2023

(54) INSERT DEVICE FOR FUEL INJECTION

(71) Applicant: Transportation IP Holdings, LLC, Norwalk, CT (US)

(72) Inventors: Brett Heher, Pittsburgh, PA (US); Kevin Paul Bailey, Mercer, PA (US); Manuel Licon Flores, Erie, PA (US); Adam Edgar Klingbeil, Ballston Lake, NY (US); John Patrick Dowell, Grove City, PA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 0 days.

(21) Appl. No.: 17/369,561

(22) Filed: Jul. 7, 2021

(65) Prior Publication Data

US 2023/0012000 A1 Jan. 12, 2023

(51) Int. Cl.
*F02M 61/14* (2006.01)
*F02M 61/16* (2006.01)
(Continued)

(52) U.S. Cl.
CPC ..... *F02M 61/14* (2013.01); *F02M 61/16* (2013.01); *B01F 23/232* (2022.01);
(Continued)

(58) Field of Classification Search
CPC .... F02M 61/14; F02M 61/16; F02M 2200/85; B01F 23/232; B01F 25/31241; B01F 2101/503; B05B 7/12
(Continued)

(56) References Cited

U.S. PATENT DOCUMENTS 1,136,818 A * 4/1915 Leissner ..... F02B 19/14 123/255
1,213,911 A 1/1917 Schmid
(Continued)

FOREIGN PATENT DOCUMENTS

DE 102018133036 A1 7/2019
JP 831250 A 11/1996
(Continued)

OTHER PUBLICATIONS

"Best Practices For Press Fit Assembly"; Journal Article; Retrieved from the internet; URL: https://www.assemblymag.com/articles/93984-best-practices-for-press-fit-assembly; Author Jim Camillo (Year: 2017).*
(Continued)

*Primary Examiner* — Sizo B Vilakazi
*Assistant Examiner* — Brian R Kirby
(74) *Attorney, Agent, or Firm* — The Small Patent Law Group LLC; Christopher R. Carroll

(57) ABSTRACT

An insert device includes a first coupling body inserted into an engine cylinder head. The first coupling body extends around a center axis to define a first interior volume of the first coupling body that is shaped to receive a distal tip of a fuel injector. The insert device includes a second mixing body coupled with the first coupling body and extending around the center axis. The second mixing body includes conduits that receive fuel from the fuel injector and air from a combustion chamber, combine the fuel with the air, and direct the fuel-air mixture into the combustion chamber. The first coupling body has a first end surface positioned to face the cylinder head and the first coupling body is tapered such that an outer diameter of the first coupling body is larger toward the first end surface than toward the second mixing body.

20 Claims, 11 Drawing Sheets

(51) Int. Cl.

| | |
|---|---|
| ***B05B 7/12*** | (2006.01) |
| ***B01F 23/232*** | (2022.01) |
| ***B01F 25/312*** | (2022.01) |
| ***B01F 101/00*** | (2022.01) |

(52) U.S. Cl.
CPC ... *B01F 25/31241* (2022.01); *B01F 2101/503* (2022.01); *B05B 7/12* (2013.01); *F02M 2200/85* (2013.01)

(58) Field of Classification Search
USPC ..... 123/470, 273, 275
See application file for complete search history.

(56) References Cited

U.S. PATENT DOCUMENTS

| | | | | |
|---|---|---|---|---|
| 1,260,408 | A | 3/1918 | Leissner | |
| 1,747,935 | A * | 2/1930 | Hemmingsen | F02M 61/18 239/584 |
| 1,948,557 | A * | 2/1934 | Baur | F02M 61/14 239/289 |
| 2,470,351 | A | 5/1949 | Hartridge | |
| 2,631,577 | A * | 3/1953 | Carter | F01L 3/22 123/188.8 |
| 2,733,630 | A | 2/1956 | Saives | |
| 3,683,873 | A * | 8/1972 | Tarter | B23P 6/00 29/898.07 |
| 3,785,628 | A | 1/1974 | Lang | |
| 4,112,906 | A * | 9/1978 | Spencer | F02F 1/38 123/193.5 |
| 4,177,948 | A | 12/1979 | Schaffitz et al. | |
| 4,566,634 | A | 1/1986 | Wiegand | |
| 4,620,516 | A | 11/1986 | Reum et al. | |
| 5,024,193 | A | 1/1991 | Graze, Jr. | |
| 5,035,358 | A | 7/1991 | Katsuno et al. | |
| 5,067,467 | A | 11/1991 | Hill et al. | |
| 5,218,943 | A * | 6/1993 | Takeda | F02D 35/0038 123/549 |
| 5,315,973 | A | 5/1994 | Hill et al. | |
| 5,345,913 | A * | 9/1994 | Belshaw | F02M 61/14 123/470 |
| 5,772,122 | A | 6/1998 | Sugiura et al. | |
| 6,095,437 | A * | 8/2000 | Nozawa | F02D 7/02 239/408 |
| 6,119,658 | A * | 9/2000 | Jehle | F02M 61/14 123/41.31 |
| 6,698,412 | B2 | 3/2004 | Dalla Betta | |
| 7,028,918 | B2 * | 4/2006 | Buchanan | F02M 53/043 239/132.3 |
| 7,210,448 | B2 | 5/2007 | Stanton et al. | |
| 7,213,564 | B2 | 5/2007 | Hill et al. | |
| 7,383,818 | B1 * | 6/2008 | Beardmore | F02M 61/14 123/470 |
| 7,484,499 | B2 * | 2/2009 | Beardmore | F02M 61/14 123/470 |
| 8,668,156 | B2 | 3/2014 | Lee et al. | |
| 8,950,176 | B2 | 2/2015 | Uzkan et al. | |
| 8,960,156 | B2 * | 2/2015 | Martinsson | F02M 61/168 123/470 |
| 9,243,580 | B2 | 1/2016 | Mariucci | |
| 9,429,127 | B2 | 8/2016 | Hongo et al. | |
| 9,506,439 | B2 * | 11/2016 | Anders | F02D 41/38 |
| 9,587,606 | B2 | 3/2017 | Anders et al. | |
| 9,797,351 | B2 | 10/2017 | Svensson et al. | |
| 9,803,538 | B2 | 10/2017 | Anders et al. | |
| 9,890,689 | B2 * | 2/2018 | Hampson | F02D 41/3005 |
| 10,012,196 | B1 * | 7/2018 | Qi | F02B 23/0648 |
| 10,036,355 | B2 * | 7/2018 | Franks | F02M 53/043 |
| 10,041,440 | B2 * | 8/2018 | Di Pietro | F02M 61/14 |
| 10,072,606 | B2 * | 9/2018 | Brunner | F02M 61/14 |
| 10,451,014 | B2 * | 10/2019 | Ting | F02B 19/12 |
| 10,711,752 | B2 * | 7/2020 | Martin | F02M 61/168 |
| 10,808,601 | B2 * | 10/2020 | Hashizume | F02B 23/0651 |
| 11,008,932 | B2 | 5/2021 | Klingbeil et al. | |
| 2002/0002967 | A1 | 1/2002 | Paul et al. | |
| 2003/0155432 | A1 * | 8/2003 | Buchanan | F02M 61/14 239/132.3 |
| 2003/0196634 | A1 * | 10/2003 | Lausch | F02B 19/12 123/275 |
| 2009/0320774 | A1 | 12/2009 | Liebsch et al. | |
| 2010/0236533 | A1 * | 9/2010 | Meldolesi | F01L 3/22 123/188.8 |
| 2011/0067653 | A1 * | 3/2011 | Clark | F02F 1/242 123/41.31 |
| 2011/0068188 | A1 | 3/2011 | Laimboeck | |
| 2011/0126462 | A1 | 6/2011 | Livshits et al. | |
| 2012/0186555 | A1 | 7/2012 | Mueller | |
| 2014/0084085 | A1 | 3/2014 | Hongo et al. | |
| 2014/0150758 | A1 | 6/2014 | Zurlo et al. | |
| 2015/0211410 | A1 * | 7/2015 | Saville | F01P 3/16 123/41.82 R |
| 2015/0211461 | A1 | 7/2015 | Shirk et al. | |
| 2015/0219051 | A1 | 8/2015 | Carpenter et al. | |
| 2016/0024994 | A1 | 1/2016 | Engineer | |
| 2016/0084411 | A1 | 3/2016 | Laws | |
| 2016/0097360 | A1 * | 4/2016 | Mueller | F02M 61/1813 123/294 |
| 2016/0245224 | A1 | 8/2016 | Ruona et al. | |
| 2016/0298528 | A1 | 10/2016 | Svensson | |
| 2016/0298529 | A1 * | 10/2016 | Anders | F02B 23/02 |
| 2016/0298584 | A1 | 10/2016 | Svensson | |
| 2016/0303672 | A1 | 10/2016 | Onley et al. | |
| 2016/0327000 | A1 | 11/2016 | John | |
| 2017/0009712 | A1 | 1/2017 | Svensson et al. | |
| 2017/0089310 | A1 | 3/2017 | Svensson | |
| 2017/0114763 | A1 | 4/2017 | Mueller | |
| 2018/0149125 | A1 * | 5/2018 | Ting | F02M 53/043 |
| 2018/0195430 | A1 | 7/2018 | Fitzgerald | |
| 2018/0202403 | A1 | 7/2018 | Huff | |
| 2019/0017464 | A1 * | 1/2019 | Schlee | H01T 13/08 |
| 2019/0063391 | A1 * | 2/2019 | Martin | F02M 61/1806 |
| 2019/0218959 | A1 * | 7/2019 | Klingbeil | F02B 23/0654 |
| 2020/0040857 | A1 * | 2/2020 | Kurtz | F02M 61/182 |
| 2020/0191045 | A1 | 6/2020 | Gubba | |

FOREIGN PATENT DOCUMENTS

| | | | | |
|---|---|---|---|---|
| JP | 2012125711 | A | 7/2012 | |
| KR | 100665727 | B1 | 1/2007 | |
| WO | WO-2007058103 | A1 * | 5/2007 | F02D 41/3094 |
| WO | 2015187653 | A1 | 12/2015 | |

OTHER PUBLICATIONS

O'Connor et al., "Post Injections for Soot Reduction in Diesel Engines: A Review of Current Understanding", SAE Int. J. Engines, vol. 06, Issue: 01, pp. 400-421, 2013.

O'Connor et al., "Effect of Load on Close Coupled Post-Injection Efficacy for Soot Reduction in an Optical Heavy-Duty Diesel Research Engine", J. Eng. Gas Turbines Power, vol. 136, Issue: 10, pp. 16, May 2, 2014.

Office Action dated Aug. 21, 2020 for corresponding DE Application No. 10 2018 133 036.7 (12 pages).

First Examination Report dated Mar. 3, 2022 for corresponding Australian Patent Application No. 2021201025 (4 pages).

First Office Action dated Nov. 3, 2022 for Chinese Application No. 2021102128391 (14 pages).

English translation of the First Office Action dated Nov. 3, 2022 for Chinese Application No. 2021102128391 (17 pages).

Examination Report dated Nov. 22, 2022 for corresponding German Application No. 102021103946.0 (36 pages) Machine English translation provided.

* cited by examiner

INSERT DEVICE FOR FUEL INJECTION

GOVERNMENT LICENSE RIGHTS

This invention was made with government support under Cooperative Agreement DEEE0009199 awarded by the Office of Energy Efficiency and Renewable Energy. The government has certain rights in the invention.

BACKGROUND

Technical Field

The subject matter described herein relates to devices and methods for mixing fuel and air into a fuel-and-air mixture prior to injection of the mixture into engine cylinders.

Discussion of Art

In a compression ignition engine, fuel may be directly injected into compressed hot gases, such as air or a mixture of air and recycled exhaust gas. The fuel mixes with these in-cylinder gases near the site of injection of the fuel into the cylinders of the engine. As the relatively cool fuel mixes with the higher temperature gases, the resulting mixture reaches a temperature sufficient for ignition. This may be a dynamic event and fuel may be ignited and may burn at the head of a fuel spray plume while fuel continues to be injected into the other end of the spray plume.

As the temperature of the gases entrained into the injected fuel remains elevated, the delay between injection of the fuel and ignition of the fuel-and-air mixture in a cylinder may be reduced. This may cause the fuel spray plume to have a sub-optimal fuel-and-air mix ratio before initial ignition, which may produce soot. The production and consequential build-up of soot may degrade performance of the engine and eventually require cleaning or other repair of the engine. Additionally, certain regulations or laws may restrict how much particulate matter or other emissions can be generated by engines.

Insert devices may be placed between fuel injectors and combustion chambers of engine cylinders to mix fuel and air before the mixture of fuel and air is directed into the combustion chambers. These insert devices can be exposed to extreme temperatures, which can introduce mechanical stress to the insert devices due to these devices having different coefficients of thermal expansion (CTE) than the cylinder heads to which the insert devices are coupled. This stress can damage or destroy the insert devices and/or cylinder heads. Accordingly, a need exists for insert devices that reduce or eliminate these stresses to increase the useful lives of the insert devices.

Additionally, the insert devices may include conduits through which fuel is received from fuel injectors. The conduits can be difficult to align with holes in the fuel injectors from which the fuel is ejected due to the small distances between the fuel injectors and the insert devices. Misalignment of the conduits of the insert devices and holes in the fuel injectors may interfere with the flow of fuel into the engine cylinders and can be detrimental to operation of the cylinders. Therefore, another need exists for a way to align the conduits of the insert devices with holes in fuel injectors.

BRIEF DESCRIPTION

In one example, an insert device is provided that includes a first coupling body shaped to be inserted into a receptacle of a cylinder head of an engine cylinder. The first coupling body extends around a center axis to define a first interior volume of the first coupling body that is shaped to receive one or more of a distal tip of a fuel injector. The insert device also includes a second mixing body coupled with the first coupling body and extending around the center axis. The second mixing body includes conduits configured to receive fuel output by the fuel injector and air from the combustion chamber, combine the fuel with the air into a fuel-air mixture, and direct the fuel-air mixture into the combustion chamber of the engine cylinder. The first coupling body has a first end surface positioned to face the cylinder head and the first coupling body is tapered such that an outer diameter of the first coupling body is larger toward the first end surface than toward the second mixing body.

In another example, an insert device is provided that includes a first body shaped to mate with a cylinder head receptacle. The first body is shaped to receive a tip of a fuel injector from which fuel is ejected. The insert device also includes a second body integrally formed with the first body. The second body can include conduits configured to receive the fuel ejected by the fuel injector, mix the fuel with air into a fuel-air mixture, and direct the fuel-air mixture into an engine cylinder combustion chamber. The first body can include one or more internal chambers that permit the first body to flex and reduce thermal stress in the first body as the first body thermally expands.

In another example, another insert device is provided. The insert device includes a first body shaped to be inserted into a receptacle of a cylinder head of an engine cylinder and a second body coupled with the first body and including conduits configured to receive fuel output by a fuel injector, mix the fuel with air drawn into the second body into a fuel-air mixture, and direct the fuel-air mixture into a combustion chamber of the engine cylinder. The first body and/or the second body includes an interior flat surface positioned to mate with a corresponding flat portion of the fuel injector to align output of fuel from the fuel injector with the conduits in the second body.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
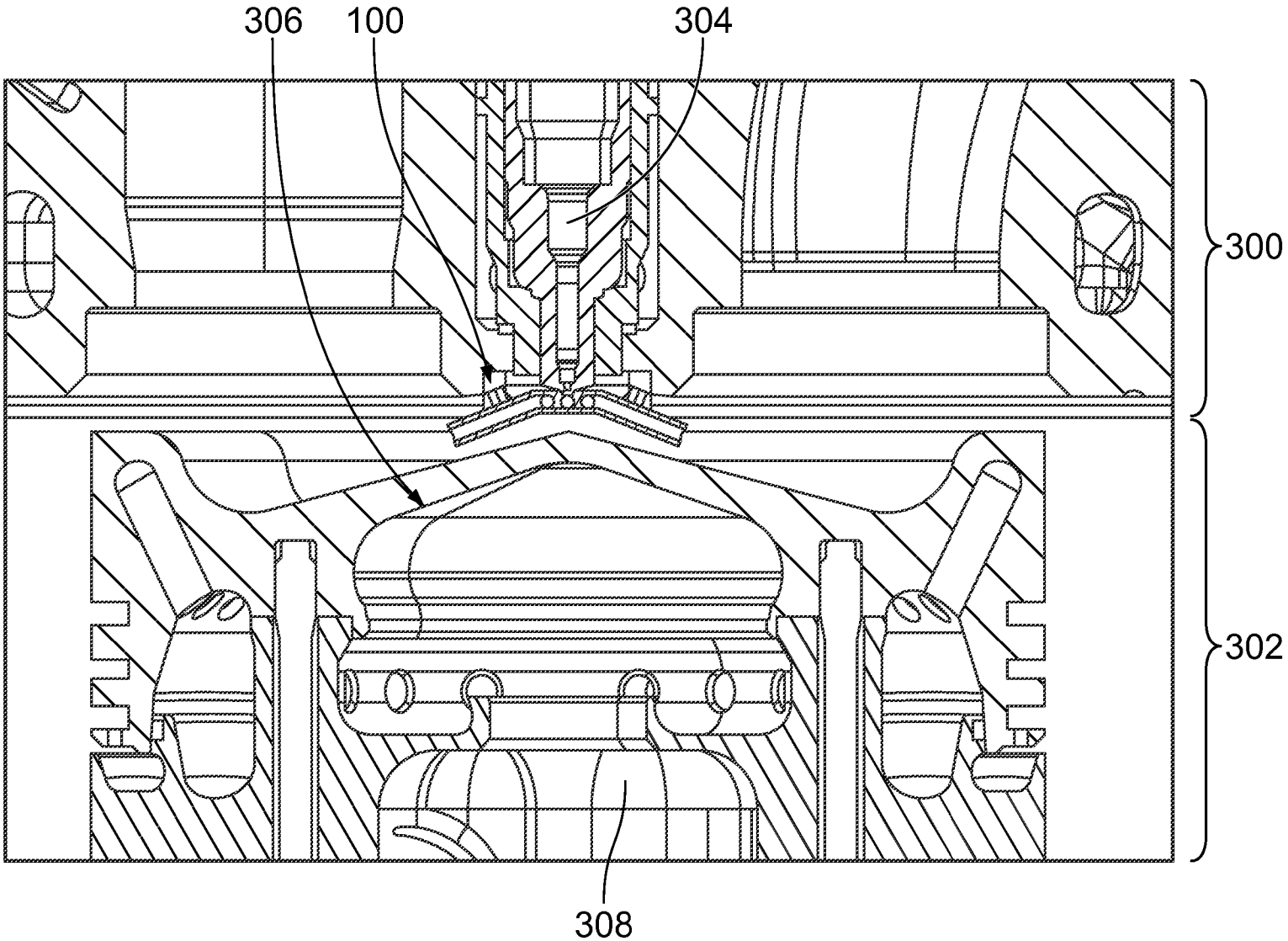
FIG. 1 illustrates a cross-sectional view of one example of an insert device coupled to a cylinder head of an engine cylinder in an engine.

Embodiments of the subject matter described herein relate to insert devices and methods that mix fuel and gas (e.g., air) into a fuel-and-gas (or fuel-and-air) mixture that is then directed into engine cylinders. The insert devices may affect and/or control an ignition delay of the fuel (e.g., by delaying the ignition relative to the time of injection). Ignition control may allow for a different (e.g., leaner) fuel-and-air mixture to be achieved prior to the mixture arriving at a region of combustion to ignite or combust. Several concepts are described herein that facilitate this modification of the fuel combustion event. Although tubes and ducts may be used in some assemblies, other insert devices define channels, flow paths, conduits, and the like and do not include a tube structure nor include a duct structure within the combustion chamber of a cylinder. Some devices having tubes or ducts have been shown to suffer from catastrophic failures, such as explosions occurring within the tubes.

With reference to some of such concepts, the insert devices may be placed in cylinder heads between fuel injectors and pistons inside engine cylinders, or may be disposed on top of the pistons. The insert devices may control (e.g., reduce) an amount of hot gas that is entrained into an injected fuel stream. A fuel injector may inject the fuel and may have a nozzle that forms a plurality of fuel streams. By adding in these insert devices, the fuel and air may have more time to mix prior to igniting in the engine cylinders. Additionally, the ratio of fuel to gas/air may be controlled, which may reduce or eliminate the production of certain exhaust products (e.g., soot, NOx) during the combustion process. The inventive insert devices described herein also can be referred to as mixing structures or mixing assemblies.

By adding these insert devices to engines, the devices may contact the hot gas and air to act as a heat sink. In this way, the insert devices may locally cool the previously hot gas/air as the gas/air is incorporated into, entrained, and/or swept along with a fuel stream plume inside the insert devices. The insert devices may cool the gases that may be entrained into fuel streams injected into the cylinders. A cooler mixture may delay ignition and thereby reduce an amount of soot generated or prevent generation of soot altogether. Various embodiments of the insert devices may be referred to as a soot reduction assembly or an engine assembly. As used herein, the terms gas or gases are inclusive of air, a combination of air and recycled exhaust gas (EGR), a combination of air and other diluents (e.g., water vapor, CO2, and/or N2, etc.), air modified to change the oxygen concentration, and a combination of any of the foregoing with aspirated natural gas.

Alternatively, one or more embodiments of the insert devices may include ducts that align with outlets of a fuel injector to form a ducted fuel injector. The fuel injector outlets can align with the ducts inside and extending through the insert devices (from the internal volume to the external surface of the insert device).

As described herein, various embodiments of the insert devices include features or designs that reduce or eliminate mechanical stress caused by the elevated temperatures to which the insert devices are exposed. Reducing these stresses can increase the useful lives of the insert devices and/or cylinder heads.

The insert device can be additively manufactured using three-dimensional printing, direct metal laser sintering, or the like. The insert device can be formed from the same material or a combination of materials. The insert device can be a homogenous body having a consistent formulation and density throughout all of the device body. For example, the relative amounts of or ratio of weights, volumes, or both weights and volumes of materials used to form the insert device can be the same throughout all of the insert device, regardless of the size or shape of any part of the insert device. Alternatively, the insert device can be a non-homogenous body with the relative amounts of or ratio of weights, volumes, or both weights and volumes of materials differs in different locations of the insert device. The insert device may be monolithic in that the insert device is formed as a single piece body and is not created by forming separate parts that are later joined together to form the insert device. The bodies of the monolithic insert device can be integrally formed with each other as a single body. The monolithic aspect or nature of the insert device can be identified or verified by an absence of any seams or interfaces between different parts that are joined together to form the insert device. Alternatively, the insert device may not be a monolithic body in that the insert device is formed as several separate pieces that are later joined together to form the insert device. The non-monolithic aspect or nature of the insert device can be identified or verified by seams or interfaces between different parts that are joined together to form the insert device.

The additive manufacturing process for forming the insert device can involve sequentially constructing the device body layer by layer. Suitable processes include, for example, selective laser melting (or sintering) and binder jetting. Selective laser melting involves depositing a layer of powder on a build plate and fusing selective portions of the power using a ytterbium fiber laser that scans a computer aided design (CAD) pattern or file. Binder jetting creates a part by intercalating metal powder and polymer binding agent that bind the particles and layers together without the use of laser heating.

Different portions of the insert device can be additively manufactured from different materials. For example, the portion of the insert device that abuts or contacts the cylinder head of an engine cylinder may be formed from a first material (e.g., metal or metal alloy, polymer, ceramic, etc.) having a CTE that is the same as or closer to the CTE of the cylinder head, while another portion of the insert device that does not abut or contact the cylinder head may be formed from another material having a CTE that is different from or farther from the CTE of the cylinder head (farther from the CTE of the cylinder head than the portion of the insert device that contacts the cylinder head).

The insert device may be created to have a shape that provides an interference fit between the insert device and the cylinder head. The shape of the insert device that provides the interference fit can have a taper to control the amount of interference (e.g., the force exerted on the cylinder head by the insert device). For example, the tapered shape of the insert device can provide a smaller pressure or force against the cylinder head in locations that are closer to the combustion chamber (where temperatures may be higher) and greater pressures or forces against the cylinder head in locations that are farther from the combustion chamber (where temperatures may be second).

The insert device can be formed to have an internal cutout or pocket that allow flexing of the insert device at the interference fit area (e.g., in locations that are laterally between the cylinder head and an internal volume of the insert device). As the insert device heats up, the insert device can thermally expand and flexing of the insert device can be absorbed by the internal cutout or pocket to reduce stress from thermal expansion of the insert device.

A sleeve made of a ductile material can be disposed (e.g., pressed) between the insert device and the cylinder head. The sleeve can reduce thermal expansion stresses in the cylinder head caused by the differences in CTE between the insert device and the cylinder head. The sleeve optionally can be threaded onto or into the insert device and rest against a shoulder on the cylinder head. The sleeve can support the fuel injector and retain the insert device in position relative to the fuel injector.

The fuel injector may have a flat surface on an outer perimeter of the fuel injector. The insert device can be formed to have a mating flat on an exterior surface. These flat surfaces of the fuel injector and the insert device can mate with each other to align holes or conduits in the insert device (through which fuel and air mixtures pass through and out of the insert device) with holes in the fuel injector through which fuel is ejected from the fuel injector into the insert device.

FIG. 1 illustrates a cross-sectional view of one example of an insert device 100 coupled to a cylinder head 300 of an engine cylinder 302 in an engine. The insert device may be coupled to the cylinder head in a location between a fuel injector 304 and a crown 306 of a piston 308 in the cylinder. The piston moves toward and away from the fuel injector during operation of the engine, or up and down in the perspective of FIG. 1. In the illustrated embodiment, the insert device may be stationary as the mixing structure may be mounted or otherwise affixed to the cylinder head. The piston moves toward and away from both the fuel injector and the stationary insert device. In one embodiment, the insert device may be affixed or otherwise coupled to, or incorporated into the crown of the piston such that the insert device moves with the piston toward and away from the fuel injector.

In operation, the fuel injector injects one or more streams of fuel into the central volume of the body of the insert device. During operation, the fuel streams flow from the fuel injector through a central volume of the insert device. The pressure supplied to the fuel injector may cause all or substantially all (e.g., at least 90%) of the fuel to pass through conduits of the insert device (after mixing with gases, as described herein).

As the fuel flows into the internal volume of the insert device, the moving fuel draws gases through air passages in the device (e.g., an opening along the top of the insert device, such as the side of the insert device that faces away from the piston and generally in a direction toward the fuel injector; openings above the fuel passages; openings below the fuel passages; etc.). The gases, which may be relatively hot, may be pulled through the interior of the insert device such that the hot gases move inward from outside the insert device into a center volume of the insert device.

The insert device may cool the incoming air by operating as a heat sink and/or increasing the dwell time of the air (e.g., the duration of time over which the air flows through the insert device, mixes with fuel, and enters the engine cylinder). The at least partially cooled gases then become entrained in the flow of fuel in the insert device to form a fuel-and-gas mixture inside the insert device. This fuel-and-gas mixture may be formed before the fuel or gas enters the combustion chamber of the cylinder. The fuel and gas mixes to form the fuel-and-gas mixture, which flows out of the insert device via one or more mixture conduits. The fuel-and-gas mixture then flows into the combustion chamber of the cylinder. This fuel-and-gas mixture may be cooler than fuel-and-gas mixtures that do not flow through or mix within the insert device, which may delay ignition inside the chamber of the cylinder and prevent or reduce soot formation, as described herein.

Optionally, the conduits may be oriented to direct the fuel-and-gas mixture farther into the combustion chamber of the cylinder such that the fuel-and-gas mixture penetrates further into the combustion chamber (e.g., compared to directing the fuel and gas into the combustion chamber without mixing the fuel and gas using the insert device. For example, mixing the fuel and gas in the insert device and then directing the fuel-and-gas mixture into the combustion chamber using the insert device may change the combination of mass and velocity of the mixture jet relative to the mass and velocity that the fuel and gas jet would separately have without pre-mixing the fuel and gas in the insert device. For example, the jet with the mixing structure may be more confined (e.g., narrower) than the jet would be without the insert device. Additionally, the jet may have lower initial mass entrainment but higher velocity relative to the jet without the insert device. Without the insert device, the jet could entrain more gases earlier in the flow path, which would have a high mass within the domain of the spray and spreading the spray resulting in a lower velocity and lower penetration into the cylinder. The more concentrated, higher velocity of the mixture by the insert device causes the mixture to enter farther into the combustion chamber to locations that may be farther from the insert device (relative to not using the insert device). As the penetration of the mixture into the combustion chamber increases, soot oxidation within the combustion chamber may be enhanced, which may eliminate or reduce the amount of soot in the engine cylinder.

Figure 2:
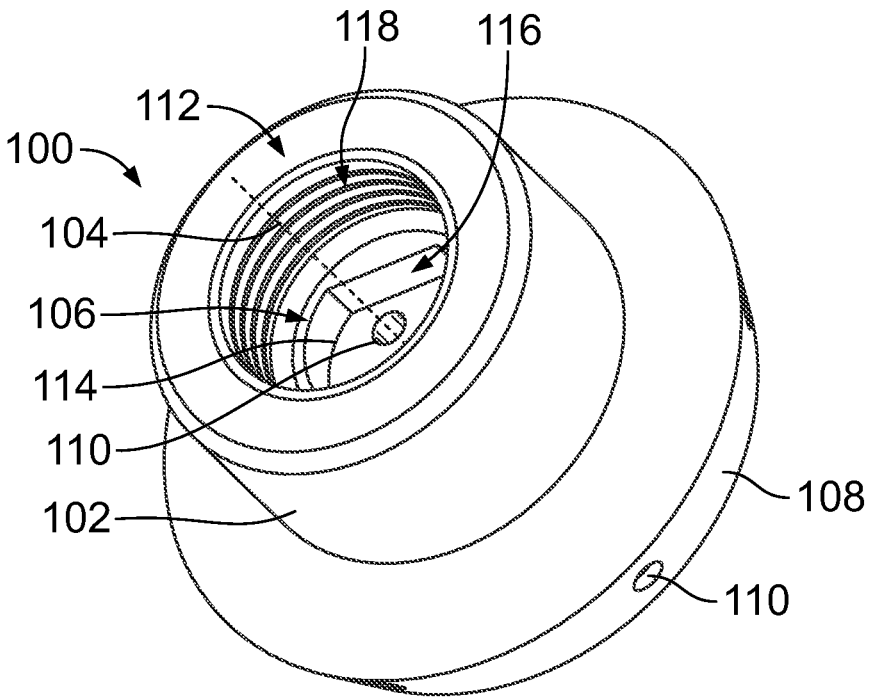
FIG. 2 illustrates a top perspective view of one example of the insert device shown in FIG. 1.
Figure 3:
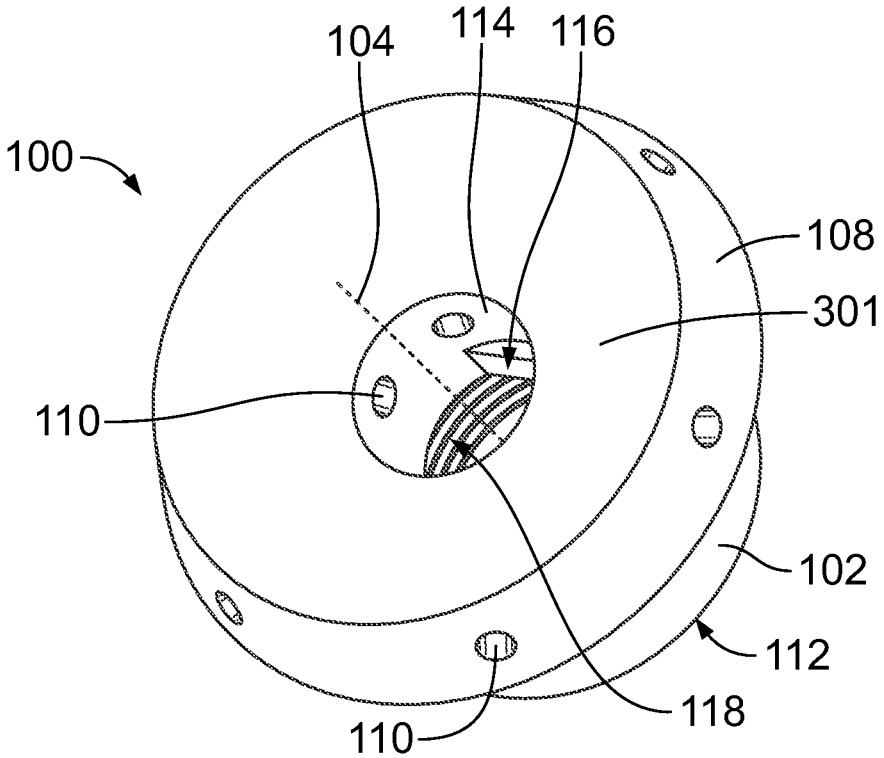
FIG. 3 illustrates a bottom perspective view of the insert device shown in FIG. 2.
Figure 4:
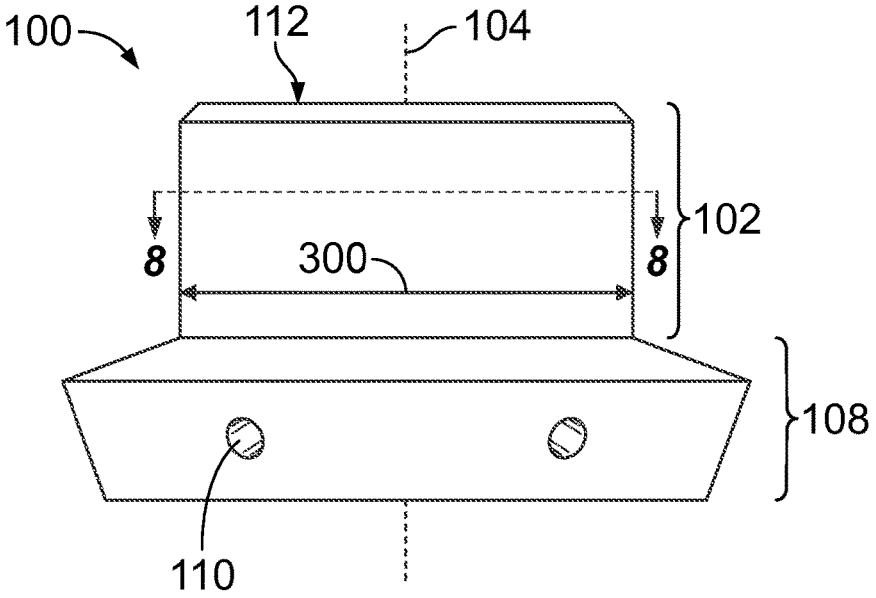
FIG. 4 illustrates a side elevational view of the insert device shown in FIG. 2.
Figure 5:
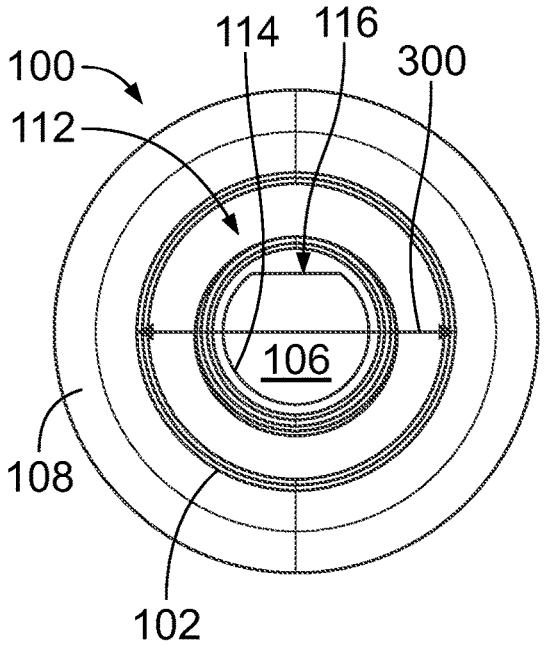
FIG. 5 illustrates a top plan view of the insert device shown in FIG. 2.
Figure 6:
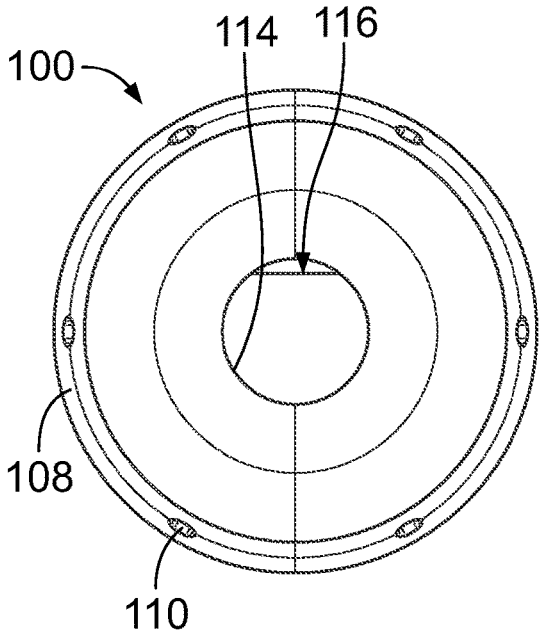
FIG. 6 illustrates a bottom plan view of the insert device shown in FIG. 2.
Figure 7:
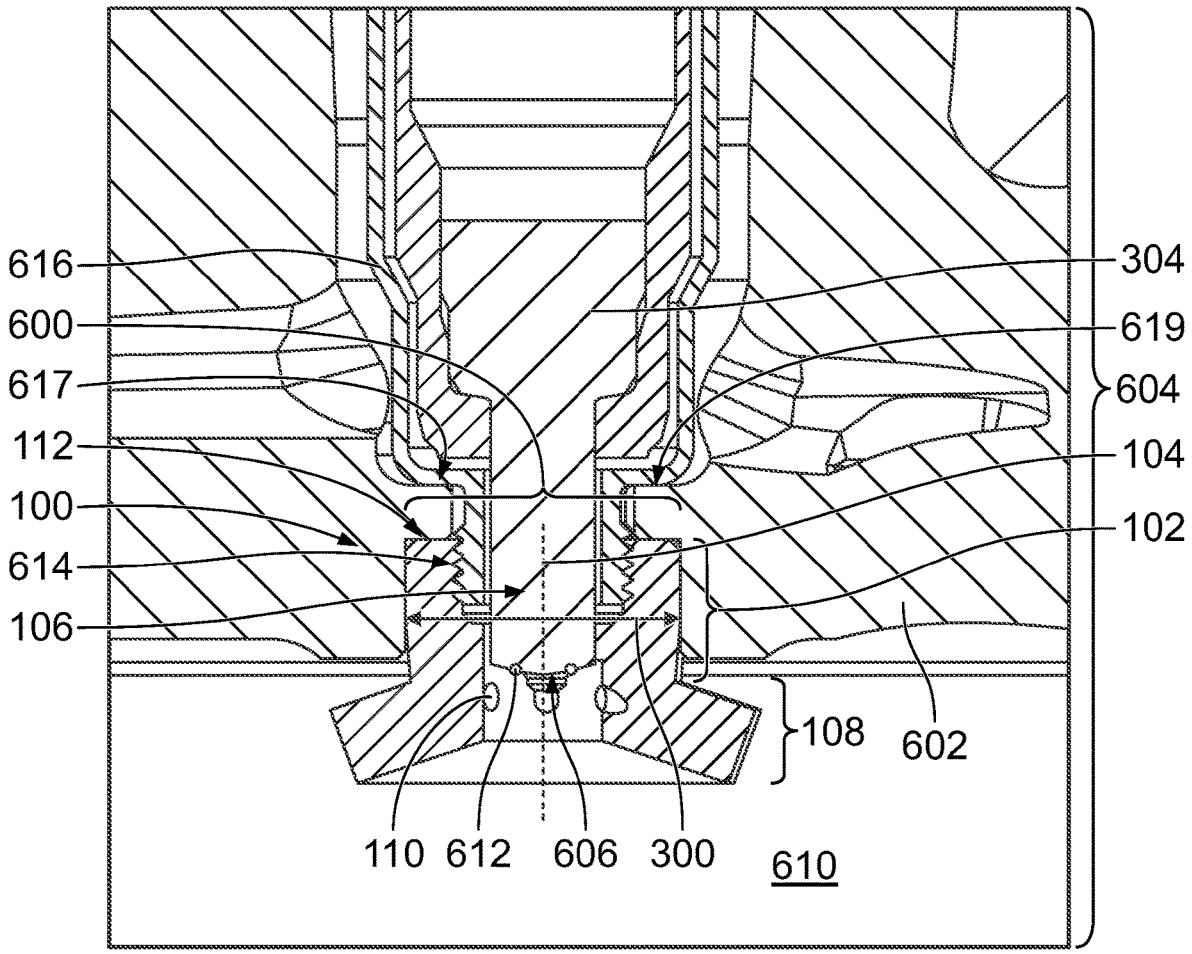
FIG. 7 illustrates a cross-sectional view of one example of the insert device shown in FIG. 2 coupled with a cylinder head of an engine cylinder.
Figure 8:
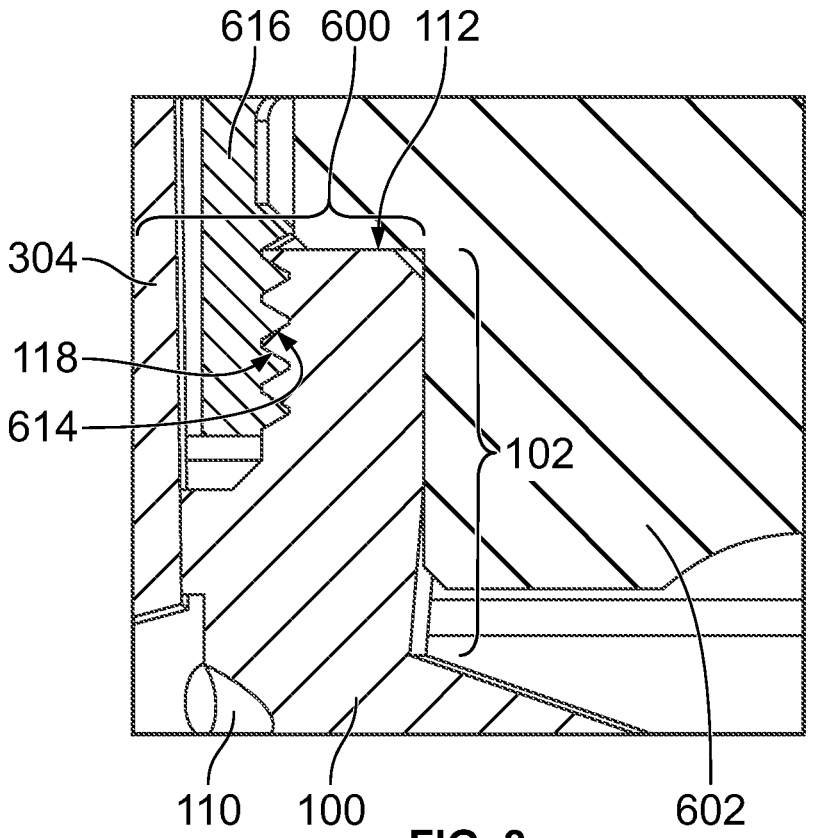
FIG. 8 illustrates another cross-sectional view of one example of the insert device shown in FIG. 2 coupled with the cylinder head of the engine cylinder.

FIG. 2 illustrates a top perspective view of one example of an insert device 100 shown in FIG. 1. FIG. 3 illustrates a bottom perspective view of the insert device shown in FIG. 2. FIG. 4 illustrates a side elevational view of the insert device shown in FIG. 2. FIG. 5 illustrates a top plan view of the insert device shown in FIG. 2. FIG. 6 illustrates a bottom plan view of the insert device shown in FIG. 2. FIG. 7 illustrates a cross-sectional view of one example of the insert device shown in FIG. 2 coupled with a cylinder head 602 of an engine cylinder 604. FIG. 8 illustrates another cross-sectional view of one example of the insert device shown in FIG. 2 coupled with the cylinder head of the engine cylinder.

The insert device includes a first coupling body 102 that is shaped to be inserted into a receptacle 600 (shown in FIG. 7) of the cylinder head of the engine cylinder. The first coupling body can have a generally cylindrical shape with a taper, as described below. The first coupling body extends around a center axis 104 of the insert device. This center axis may extend along or parallel to the length of a fuel injector 304 (as shown in FIG. 7). The first coupling body extends around and defines a first interior volume 106 of the insert device. For example, the first coupling body can be an annular body that encircles the first interior volume. While the first coupling body is shown as having a circular shape, alternatively, the first coupling body may not have a circular shape. For example, the first coupling body may include one or more linear sides.

This first interior volume is shaped to receive a distal tip 606 (shown in FIG. 7) of the fuel injector. As shown in FIG. 7, the first interior volume may be large enough to receive the distal tip and a sleeve 616 (described below) without additional volume or space being present within the first interior volume. Alternatively, the first interior volume may be larger such that one or more open volumes or gaps are disposed between any two or more of the first coupling body, the sleeve, and the fuel injector.

The insert device also includes a second mixing body 108 that is coupled with the first coupling body. The second mixing body optionally can be referred to as a second directing body. The first and second bodies of the insert device can be different portions of a single, monolithic body, or may be separate parts that are formed separately but later joined together. The second mixing body extends around the center axis of the insert. The second mixing body may have an outwardly extending flared shape or dovetail shape such that the second mixing body transitions from a smaller outer diameter of the first coupling body to a larger outer diameter of the second mixing body.

The second mixing body includes conduits 110 that are configured (e.g., shaped and/or positioned) to receive fuel output by the fuel injector. The conduits can be referred to as mixture conduits. The conduits can extend from an interior or internal surface 114 of the insert device to the outer or external surface 108 of the insert device. The internal surface of the insert body may encircle or otherwise extend around and face the center axis of the insert device. The conduits may be aligned with fuel spray holes 612 (shown in FIG. 7) of the fuel injector such that fuel ejected from the holes is directed into the conduits in the second mixing body. The conduits and holes may be aligned so the direction or trajectory of the fuel need not be changed for the fuel to flow or pass into and through the conduits, and out of the insert device.

The conduits also can receive gas (e.g., air) from outside of the insert device. For example, air may flow over a second end surface 301 of the insert device and into the internal volumes of the insert device. The second end surface faces the combustion chamber and is opposite a first end surface 112 (that generally faces away from the combustion chamber and in the direction of the fuel injector). The air may be drawn into the first internal volume by the flow of fuel into and through the conduits of the insert device. The conduits can be shaped to mix the fuel and air within the conduits into a fuel-and-air mixture. For example, each of the conduits can have a reduced size (e.g., inner diameter) relative to the internal volume of the insert device. This reduced size can help mix the fuel and air into the fuel-and-air mixture at a desired or designated fuel-to-air ratio. Changing the length of the conduits, the inner diameter of the conduits, or the like, can change this ratio.

Optionally, one or more of the conduits may receive gas (e.g., air) from outside the insert device, which then flows into the interior volume of the insert device, and then out of the insert device via one or more other conduits. There may be more conduits around the outer perimeter of the second mixing body than there are holes of the fuel injector (through which fuel is ejected). The conduits that are not aligned with the holes of the fuel injector may receive and direct air from outside the insert device into the interior volume of the insert device.

The conduits can be angled in a downward direction from the inner surfaces or interior volume of the insert device toward the outer surface of the insert device. This angled direction can direct the fuel-and-air (or fuel-air) mixture in the conduits into a combustion chamber 610 (shown in FIG. 7) of the engine cylinder 604 (shown in FIG. 7). Optionally, the conduits may not be angled downward.

As shown in FIG. 8, the first coupling body can have a tapered shape to control stresses between the insert device and the cylinder head. The first coupling body can be tapered in that the first coupling body is wider at the first end surface than at the interface between the first coupling body and the second mixing body, as shown in FIG. 7. An outer diameter 300 of the first coupling body can be different at different locations along the length of the first coupling body to provide this tapered shape. For example, the outer diameter may be largest at locations along the length of the first coupling body that are closer to the first end surface and may be shorter at locations along the length of the first coupling body that are farther from the first end surface and closer to the second mixing body. The tapered shape can cause the pressure created by the interference fit between the first coupling body and the cylinder head to be larger along the outer surface of the first coupling body (that engages or contacts the cylinder head) in locations that are closer to the first end surface and to be smaller in locations that are farther from the first end surface (and closer to the second mixing body). For example, during operation of the engine cylinder, the first coupling body may be heated to hotter temperatures in locations that are closer to the combustion chamber of the engine cylinder relative to locations that are farther from the combustion chamber. As a result, the first coupling body may thermally expand more, and the outer diameter of the first coupling body may increase more, at locations that are closer to the second mixing body than in locations that are farther from the second mixing body. While one or more embodiments shown and described herein involve the insert device being mounted to or with the cylinder head, not all embodiments are limited in this way. At least one embodiment of the insert devices can be mounted in a liner of an engine cylinder.

This tapered shape provides a transition from (a) a clearance fit between the first coupling body and the cylinder head at or closer to the interface between the first coupling body and the second mixing body to (b) the interference or transition fit between the first coupling body and the cylinder head at or closer to the first end surface of the first coupling body. Tapering the first coupling body can allow for this thermal expansion to occur without creating excessive pressure or stresses between the first coupling body and the cylinder head that would crack or otherwise damage the cylinder head or first coupling body. The tapered shape can allow for the first end of the first coupling body to maintain the interference fit or transition fit coupling between the insert device and the cylinder head without damaging the insert device and the cylinder head, while the second end of the first coupling body is able to expand without contacting the cylinder head (or, if contact is made, the created stress or pressure is reduced relative to the first coupling body not being tapered).

In the illustrated example, a sleeve 616 is arranged around the fuel injector with the distal tip of the fuel injector projecting out of a second end of the sleeve (as shown in FIG. 7). The sleeve can be formed of a ductile material, such as one or more metals or metal alloys. Alternatively, the sleeve can be formed from another type of material. The sleeve includes bent portions that form shoulders 617 that rest on steps 619 inside the cylinder head.

The sleeve can retain a coolant (e.g., water or another cooling medium) outside of the fuel injector and between the fuel injector and internal surfaces of the sleeve. The second end of the sleeve is disposed between the first coupling body of the insert device and the cylinder head. This second end of the sleeve can reduce thermal expansion stresses in the cylinder head caused by the differences in CTE between the insert device and the cylinder head. For example, the sleeve can be compressed to absorb expansion of the insert device.

As shown in FIG. 7, the second end of the sleeve includes external threads 614. These external threads outwardly protrude from the sleeve in directions oriented away from the center axis of the insert device. As shown in FIGS. 2, 3, and 7, the internal surface of the first coupling body of the insert device includes internal threads 118. Alternatively, the internal surface of the second mixing body of the insert device may include the internal threads. These internal threads inwardly protrude from the internal surface of the first coupling body in directions oriented toward the center axis of the insert device. The internal and external threads are shaped to mate with each other. The sleeve and insert device can be connected with each other and secured to each other by threading the insert device onto the sleeve and/or threading the sleeve into the insert device. The sleeve can support the fuel injector and retain the insert device in position relative to the fuel injector using this threaded connection.

Figure 9:
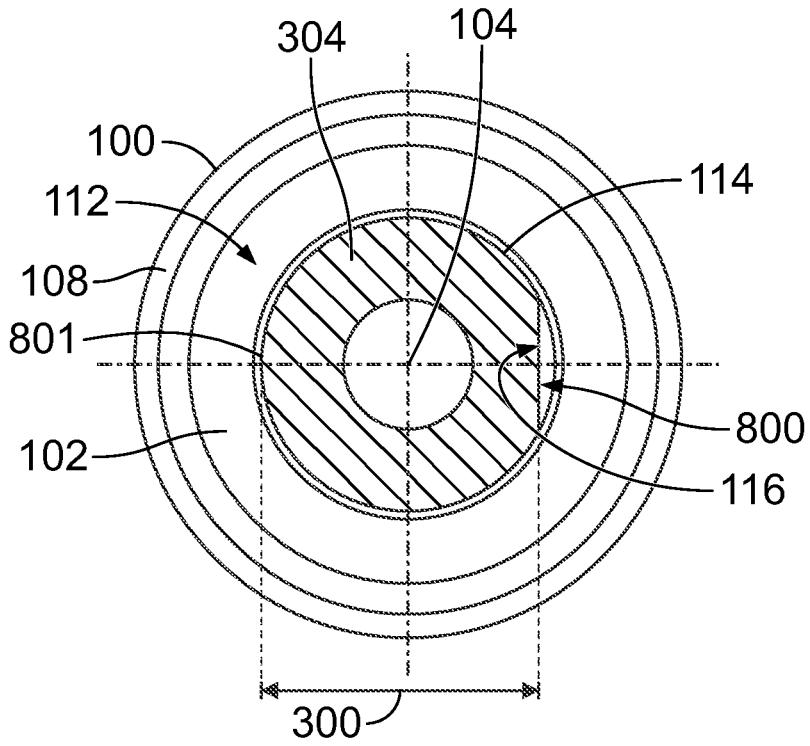
FIG. 9 illustrates a cross-sectional view of the insert device along line 8-8 shown in FIG. 4.

With continued reference to the insert device shown in FIGS. 2 through 8, FIG. 9 illustrates a cross-sectional view of the insert device along line 8-8 shown in FIG. 4. The internal surface of the insert device may include a locating flat 116. The locating flat is a portion of the internal surface that is planar or more planar than one or more other portions (or the entire remainder of) the internal surface. The internal surface may form circular shapes or paths 801 along circumferences of the internal surface at various distances along the center axis of the insert device. The locating flat may be a planar surface formed by the internal surface that is not curved like the circular shapes or paths, as shown in FIG. 9.

The locating flat may be located at a position along the circumference of the internal surface that is based on locations of the conduits in the insert body. The fuel injector may include a complementary locating flat 800 in a position that is based on locations of the holes through which fuel is ejected from the fuel injector. The locating flats of the insert device and the fuel injector can mate with each other to align a rotational position of the first coupling body to a designated orientation within the cylinder head. This designated orientation can align the mixture conduits of the insert device with the holes of the fuel injector. For example, when the locating flat of the insert device mates with the locating flat of the fuel injector, the conduits of the insert device are aligned with the holes of the fuel injector. During installation of the insert device, the mating of the locating flats against each other can be detected or felt, thereby ensuring that the insert device is properly aligned with the fuel injector.

Figure 10:
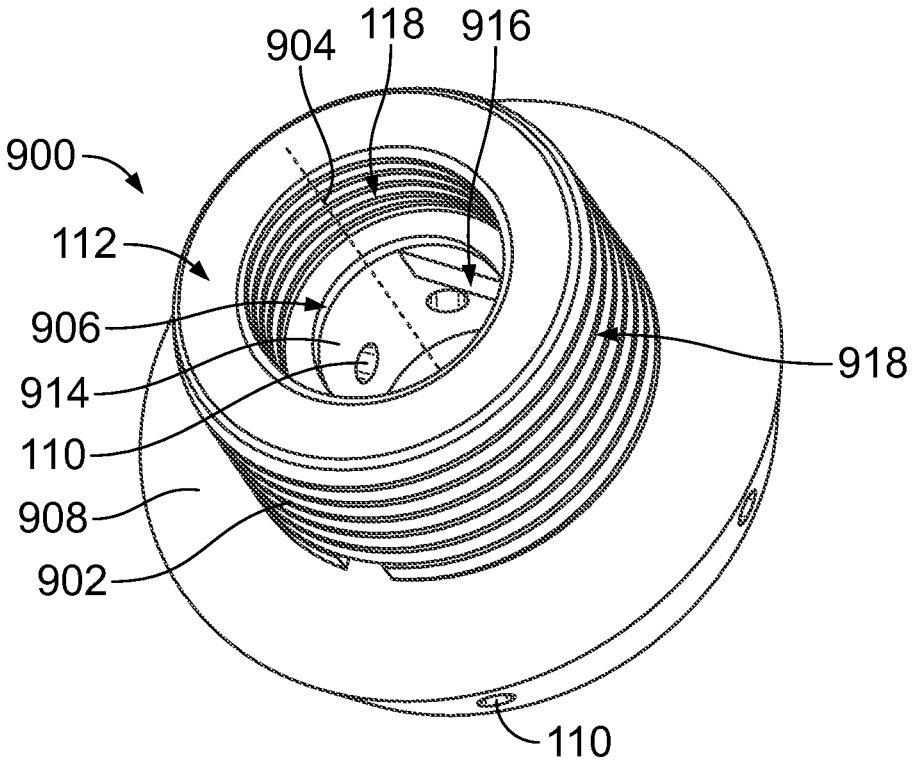
FIG. 10 illustrates a top perspective view of another example of an insert device.
Figure 11:
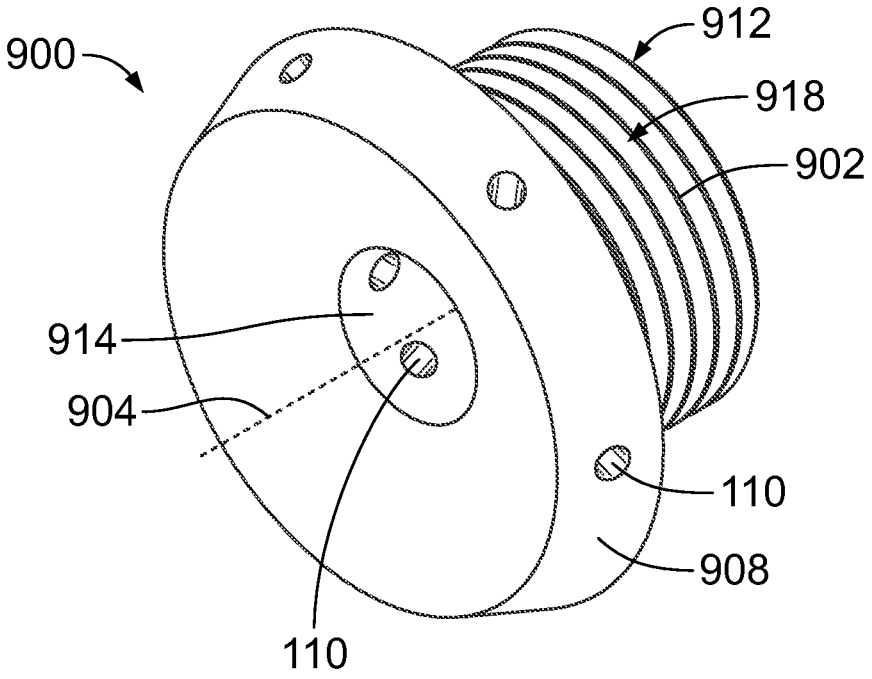
FIG. 11 illustrates a bottom perspective view of the insert device shown in FIG. 10.
Figure 12:
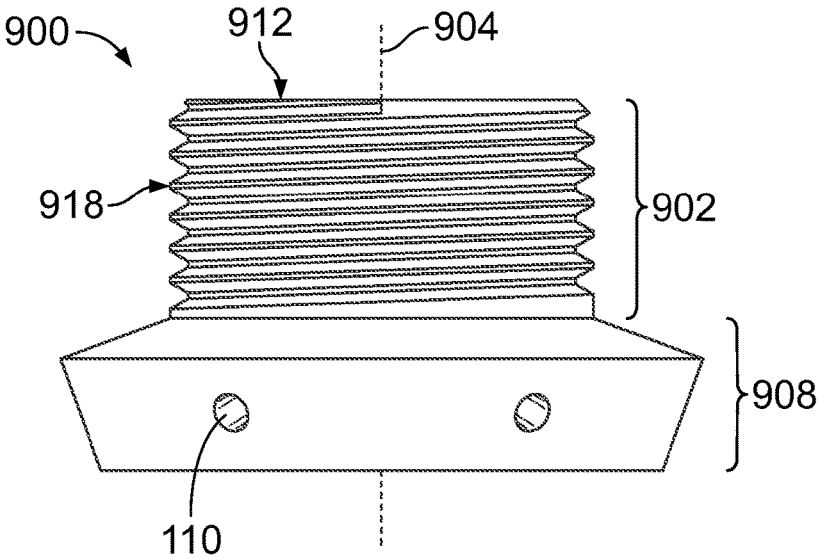
FIG. 12 illustrates a side elevational view of the insert device shown in FIG. 10.
Figure 13:
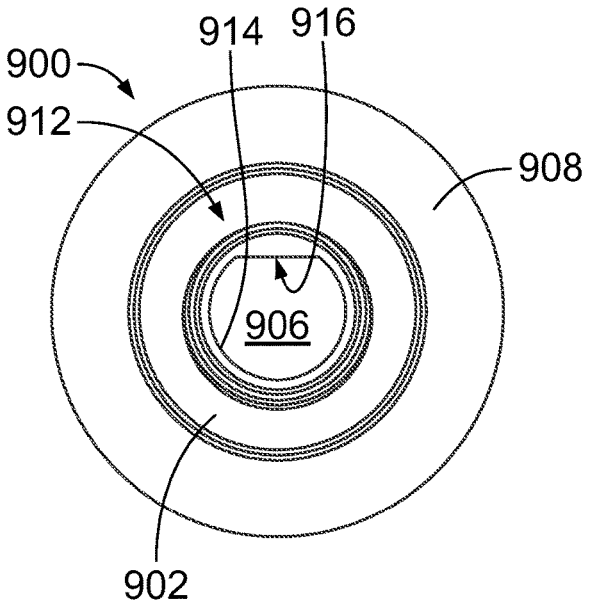
FIG. 13 illustrates a top plan view of the insert device shown in FIG. 10.
Figure 14:
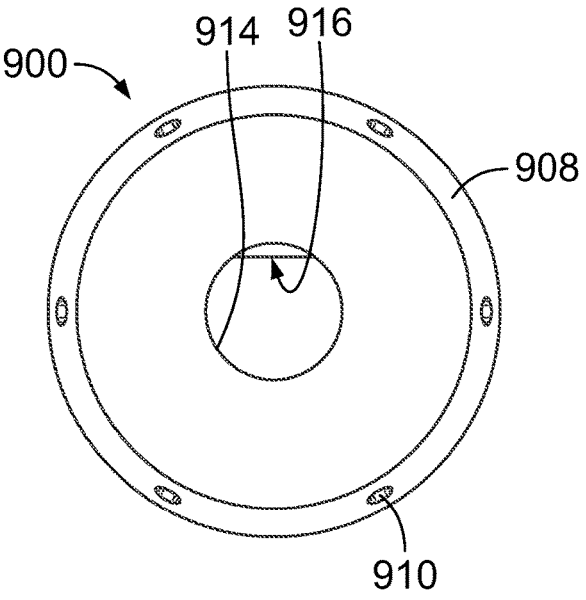
FIG. 14 illustrates a bottom plan view of the insert device shown in FIG. 10.
Figure 15:
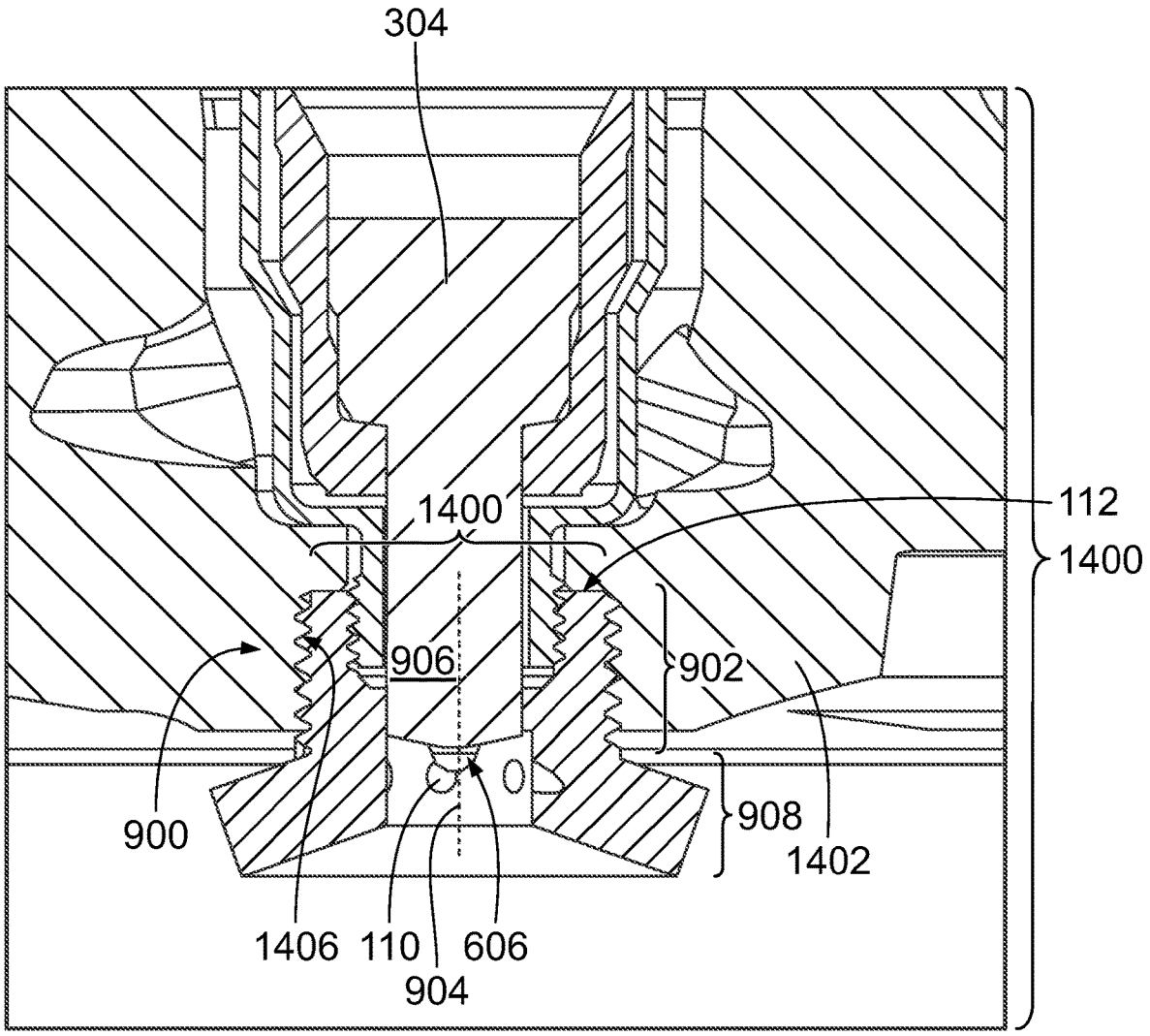
FIG. 15 illustrates a cross-sectional view of one example of the insert device shown in FIG. 10 coupled with a cylinder head of an engine cylinder.

FIG. 10 illustrates a top perspective view of another example of an insert device 900. The insert device 900 may represent the insert device 100 shown in FIG. 1. FIG. 11 illustrates a bottom perspective view of the insert device shown in FIG. 10. FIG. 12 illustrates a side elevational view of the insert device shown in FIG. 10. FIG. 13 illustrates a top plan view of the insert device shown in FIG. 10. FIG. 14 illustrates a bottom plan view of the insert device shown in FIG. 10. FIG. 15 illustrates a cross-sectional view of one example of the insert device shown in FIG. 10 coupled with a cylinder head 1402 of an engine cylinder 1404.

The insert device 900 may be similar to the insert device 100. For example, the insert device 900 may include a first coupling body 902 having the end surface 112 and a second mixing body 908 having the conduits 110. The first coupling body and the second mixing body may extend around a center axis 904 and define a central internal volume 906. The first coupling body includes an internal surface 914 that can have the internal threads 118 described above. The insert device may be coupled with the cylinder head to receive and mix fuel and air before directing the fuel-and-air mixture into the combustion chamber of the engine cylinder, as described above.

One difference between the insert devices 100, 900 is the presence of external threads 918 along an outer surface of the first coupling body of the insert device 900. The external threads may outwardly protrude from the first coupling body in directions oriented away from the center axis. As shown in FIG. 15, the insert device is received into a receptacle 1400 of the cylinder head 1402. In contrast to the cylinder head 602 shown in FIG. 7, the cylinder head 1402 may include internal threads 1406 that inwardly project (e.g., toward the insert device and toward each other). The external threads of the insert device can mate with the internal threads of the cylinder head to secure the insert device to the cylinder head.

Figure 16:
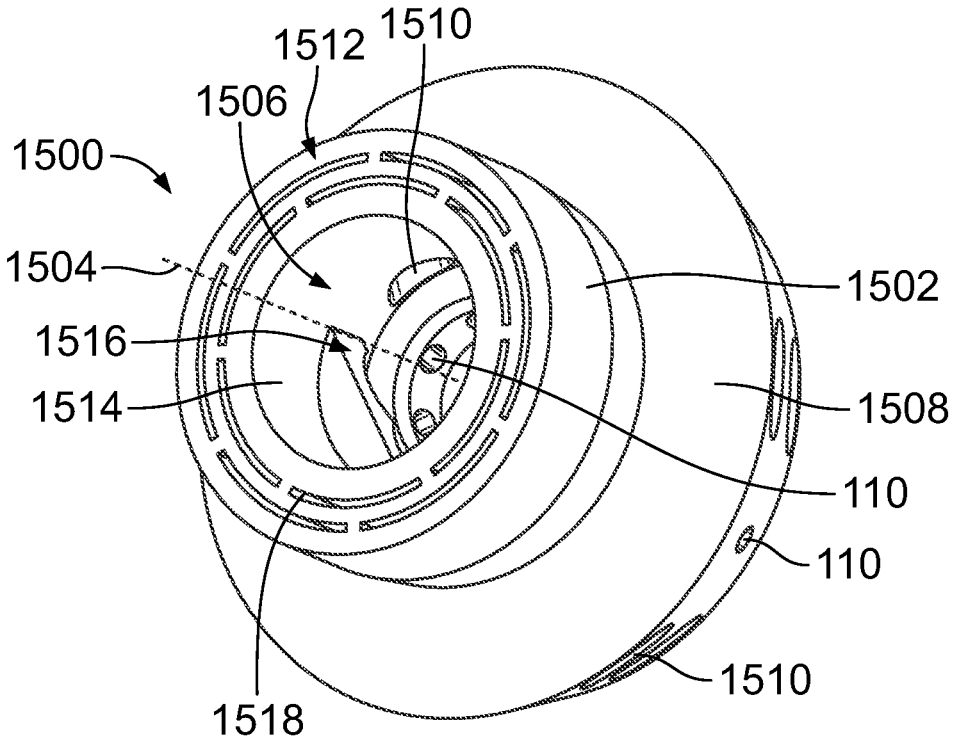
FIG. 16 illustrates a top perspective view of another example of an insert device.
Figure 17:
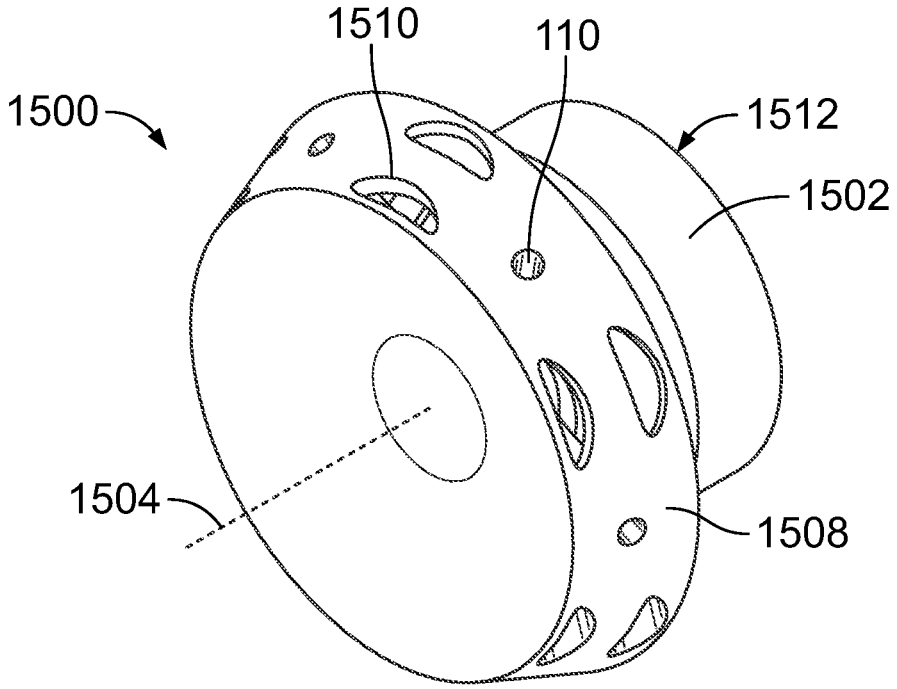
FIG. 17 illustrates a bottom perspective view of the insert device shown in FIG. 16.
Figure 18:
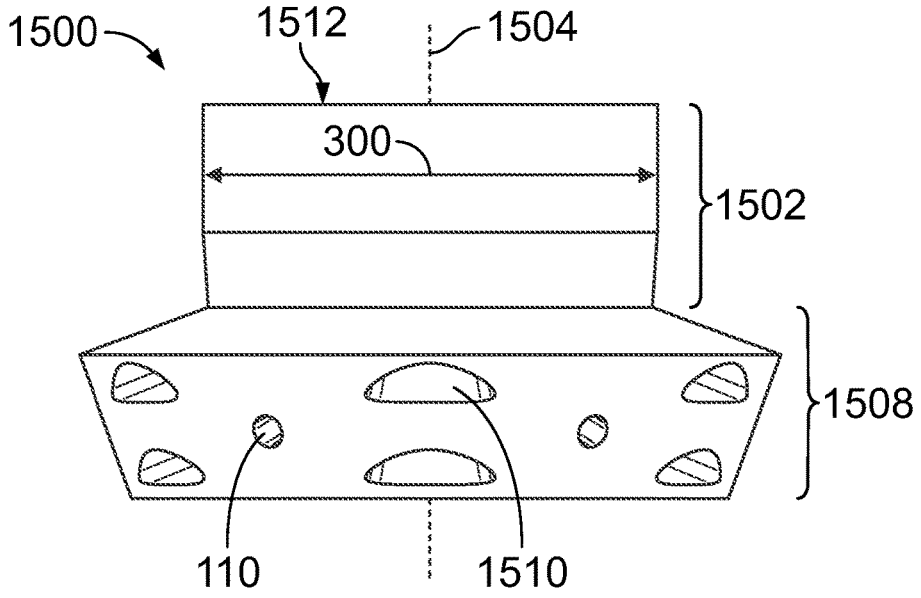
FIG. 18 illustrates a side elevational view of the insert device shown in FIG. 16.
Figure 19:
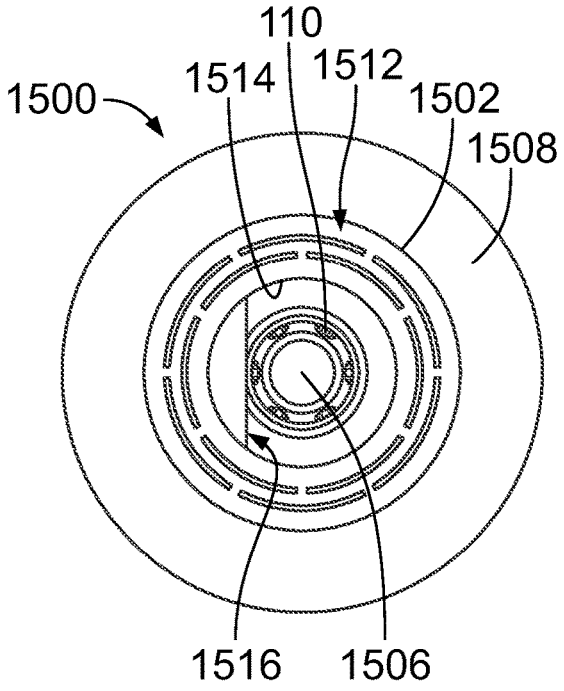
FIG. 19 illustrates a top plan view of the insert device shown in FIG. 16.
Figure 20:
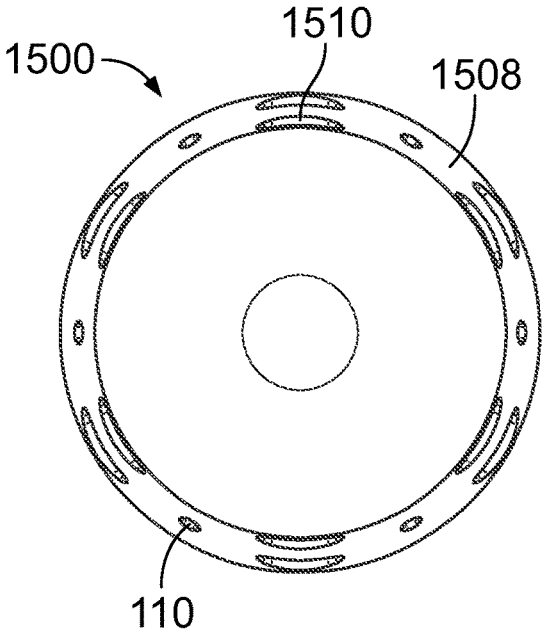
FIG. 20 illustrates a bottom plan view of the insert device shown in FIG. 16.

FIG. 16 illustrates a top perspective view of another example of an insert device 1500. The insert device 1500 can represent the insert device 100 shown in FIG. 1. FIG. 17 illustrates a bottom perspective view of the insert device shown in FIG. 16. FIG. 18 illustrates a side elevational view of the insert device shown in FIG. 16. FIG. 19 illustrates a top plan view of the insert device shown in FIG. 16. FIG. 20 illustrates a bottom plan view of the insert device shown in FIG. 16.

Figure 21:
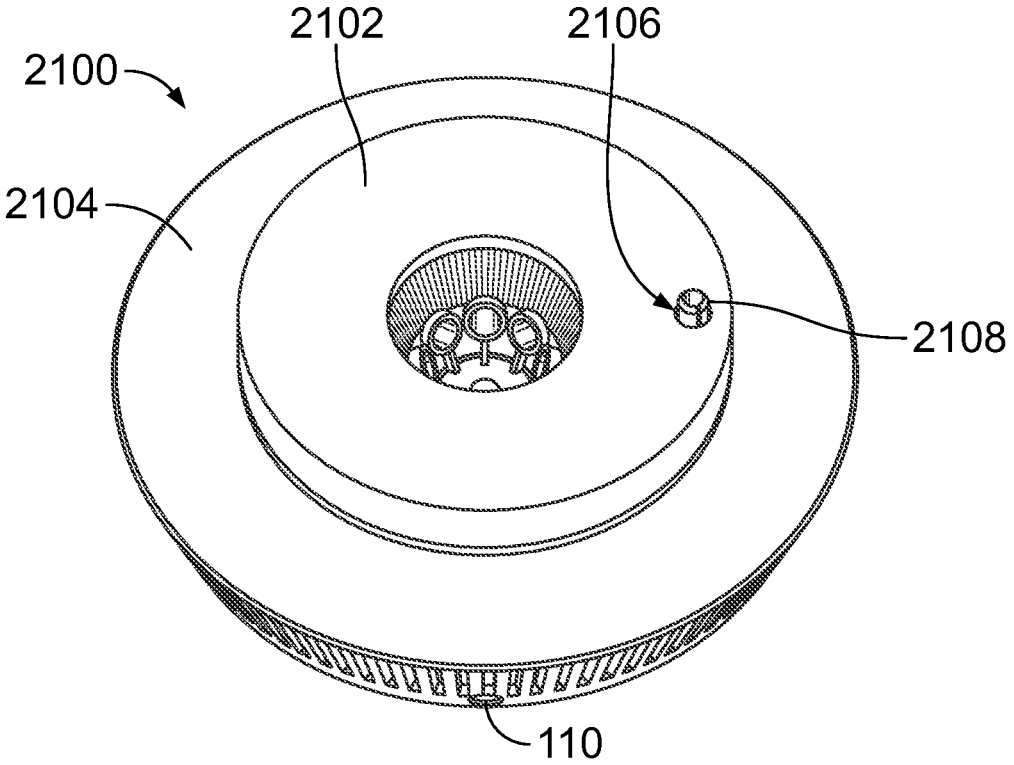
FIG. 21 illustrates another example of an insert device.

Similar to the insert device 100, the insert device shown in FIGS. 16 through 21 includes a tapered first coupling body 1502 that is shaped to be inserted into the receptacle of the cylinder head of the engine cylinder. The first coupling body extends around a center axis 1504 of the insert device. This center axis may extend along or parallel to the length of the fuel injector while the insert device is coupled with the cylinder head. The first coupling body extends around and defines a first interior volume 1506 of the insert device, similar to the first coupling body 102 and the first interior volume 106. This first interior volume is shaped to receive the distal tip of the fuel injector. As shown in FIG. 21, the first interior volume may be large enough to receive the distal tip of the fuel injector and the sleeve, similar to the insert device 100. Alternatively, the first interior volume may be larger such that one or more open volumes or gaps are disposed between any two or more of the first coupling body, the sleeve, and the fuel injector.

The insert device 1500 also includes a second mixing body 1508 that is coupled with the first coupling body. The second mixing body optionally can be referred to as a second directing body. The first and second bodies of the insert device can be different portions of a single, monolithic body, or may be separate parts that are formed separately but later joined together. The second mixing body extends around the center axis of the insert. The second mixing body has an outwardly extending flared shape or dovetail shape such that the second mixing body transitions from a smaller outer diameter of the first coupling body to a larger outer diameter of the second mixing body.

The second mixing body includes the conduits 110 described above and additional conduits 1510. In one embodiment, the conduits 1510 are air or gas conduits through which air is received from outside the insert device. This air flows through the air conduits into the interior volume of the insert device, entrains fuel ejected by the fuel injector, and exits the insert device through the conduits 110 (which can be referred to as mixture conduits) as a fuel-and-air mixture. Like the mixture conduits, the air conduits can extend from an interior or internal surface 1514 of the insert device to an outer or external surface 1508 of the insert device. The internal surface of the insert body may encircle or otherwise extend around and face the center axis of the insert device. The mixture conduits may be aligned with the holes of the fuel injector such that fuel ejected from the holes is directed into the mixture conduits in the second mixing body, as described above.

As shown in FIGS. 16 and 19, the insert device can include a locating flat 1516 that is similar or identical to the locating flat. As described above, this locating flat can interface or mate with the complementary locating flat of the fuel injector to align the mixture conduits of the insert device with the holes of the fuel injector.

The insert device can include internal pockets or cutouts 1518 that define internal chambers in the insert device. As shown in FIGS. 16 and 19, the pockets or cutouts can be voids that inwardly extend into the insert device from a first end surface 1512 of the insert device. The first end surface can face upward in the direction of the fuel injector. The internal pockets or cutouts are voids in the first coupling body that can extend into the insert device from the first end surface toward, but not all the way to, the second mixing body. Alternatively, the internal pockets or cutouts can be voids in the first coupling body that extend into the insert device from the first end surface all the way to the second mixing body. In another embodiment, the internal pockets or cutouts can be voids in the first coupling body that are between the first end surface and the second mixing body, but that are not open along the first end surface (in contrast to the embodiment shown in FIGS. 16 and 19).

The internal pockets or cutouts allow the first coupling body to flex inward and/or around internal pockets or cutouts. This can reduce thermal stress in the first coupling body as the first coupling body thermally expands. For example, the insert device may thermally expand more than the cylinder head. The increasing size of the insert device can be absorbed by flexing of the insert device inward into the voids created by the internal pockets or cutouts.

Figure 22:
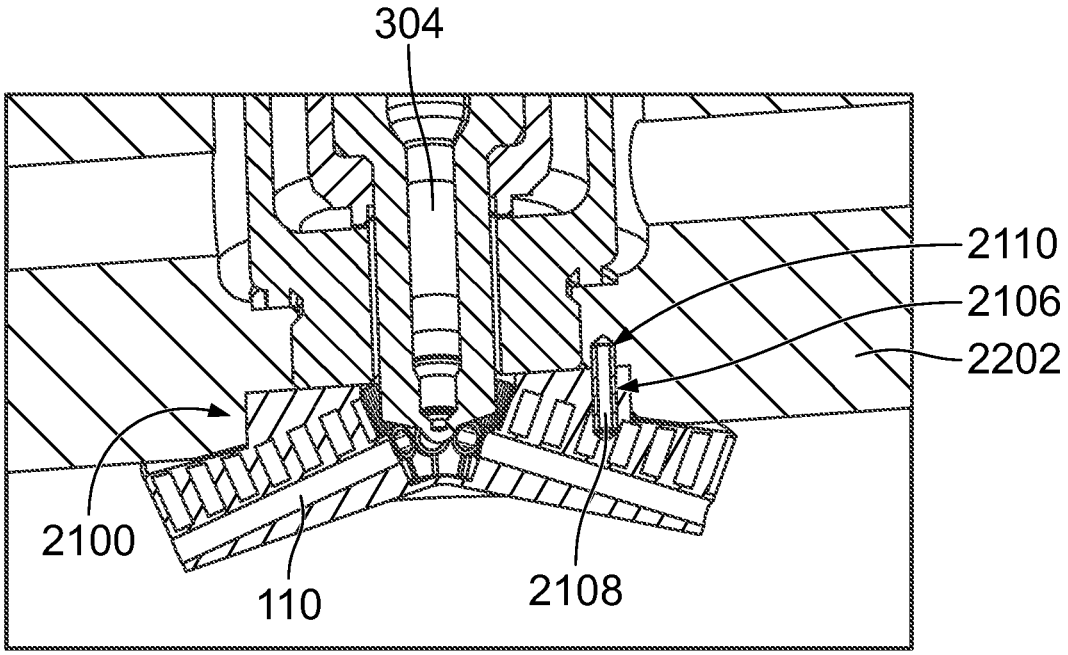
FIG. 22 illustrates a cross-sectional view of the insert device shown in FIG. 21 coupled with a cylinder head.

FIG. 21 illustrates another example of an insert device 2100. FIG. 22 illustrates a cross-sectional view of the insert device shown in FIG. 21 coupled with a cylinder head 2202. Similar to the other insert devices described herein, the insert device shown in FIGS. 21 and 22 includes a first coupling body 2102 configured to receive the distal tip of the fuel injector and a second mixing body 2104 having the mixture conduits 110 through which the fuel-and-air mixture is directed into the combustion chamber of the engine cylinder.

The insert device includes an alignment receptacle 2106 in which an alignment pin or key 2108 is disposed. Alternatively, the alignment pin or key may be additively formed with the insert device such that the insert device and the alignment pin or key are a single, monolithic body. The cylinder head can include a complementary alignment receptacle 2110. The alignment receptacles of the insert device and the cylinder head can receive opposite ends of the same elongated alignment pin or key to align a rotational position of the first coupling body to a designated orientation within the cylinder head. This designated orientation can align the mixture conduits of the insert device with the holes of the fuel injector.

For example, the receptacle in the insert device may be located at a position on the second mixing body that is based on locations of the conduits in the insert body. The receptacle in the cylinder head also can be at position that is based on locations of the holes of the fuel injector. The alignment pin or key can be received in both the receptacles (or may be received in the receptacle of the cylinder head) to align the conduits of the insert device with the holes of the fuel injector.

A method for forming one or more of the insert devices described herein can include depositing or printing a first layer of a material on a build surface. The method also can include sequentially depositing or printing one or more successive layers of the material on the first layer and/or on top of each other. This process can continue until formation of the insert device is complete.

In one example, an insert device is provided that includes a first coupling body shaped to be inserted into a receptacle of a cylinder head of an engine cylinder. The first coupling body extends around a center axis to define a first interior volume of the first coupling body that is shaped to receive a distal tip of a fuel injector. The insert device also includes a second mixing body coupled with the first coupling body and extending around the center axis. The second mixing body includes conduits configured to receive fuel output by the fuel injector and air from the combustion chamber, combine the fuel with the air into a fuel-air mixture, and direct the fuel-air mixture into the combustion chamber of the engine cylinder. The first coupling body has a first end surface positioned to face the cylinder head and the first coupling body is tapered such that an outer diameter of the first coupling body is larger toward the first end surface than toward the second mixing body.

Optionally, the first coupling body is shaped to provide an interference fit between the first coupling body and the cylinder head. The first coupling body can be shaped to provide the interference fit with a lower interference pressure between the first coupling body and the cylinder head in locations closer or nearer the combustion chamber than in other locations closed or nearer the first end surface. The first coupling body and the second directing body can be different portions of a single body having no seams or interfaces between the first coupling body and the second directing body. The first coupling body can include one or more internal chambers. The first coupling body can be configured to flex around the one or more internal chambers and reduce thermal stress in the first coupling body as the first coupling body thermally expands.

The first coupling body and/or the second mixing body can include an internal surface that extends around the center axis. The internal surface can include a locating flat positioned to mate with a corresponding flat surface of the fuel injector. The locating flat can be positioned relative to the conduits in the second directing body such that the conduits are aligned with fuel spray holes of the fuel injector while the locating flat is mated with the flat surface of the fuel injector. The first coupling body and/or the second mixing body can include an internal threaded surface shaped to mate with an outer threaded surface of a sleeve in which the fuel injector is disposed. The first coupling body can include an external threaded surface shaped to mate with an internal threaded surface of the cylinder head.

In another example, an insert device is provided that includes a first body shaped to mate with a cylinder head receptacle. The first body is shaped to receive a tip of a fuel injector from which fuel is ejected. The insert device also includes a second body integrally formed with the first body. The second body can include conduits configured to receive the fuel ejected by the fuel injector, mix the fuel with air into a fuel-air mixture, and direct the fuel-air mixture into an engine cylinder combustion chamber. The first body can include one or more internal chambers that permit the first body to flex and reduce thermal stress in the first body as the first body thermally expands.

Optionally, the first body has a tapered shape such that an outer diameter of the first body is larger in locations that are farther from the second body than in first locations closer to the second body. The tapered shape of the first body can provide an interference fit between the first body and an engine cylinder head with a lower interference pressure between the first body and the engine cylinder head in the locations that are farther from the second body than in the locations that are closer to the second body. The first body and the second body can be different portions of a single additively manufactured body having no seams or interfaces between the first body and the second body.

In another example, another insert device is provided. The insert device includes a first body shaped to be inserted into a receptacle of a cylinder head of an engine cylinder and a second body coupled with the first body and including conduits configured to receive fuel output by a fuel injector, mix the fuel with air drawn into the second body into a fuel-air mixture, and direct the fuel-air mixture into a combustion chamber of the engine cylinder. The first body and/or the second body includes an interior flat surface positioned to mate with a corresponding flat portion of the fuel injector to align output of fuel from the fuel injector with the conduits in the second body.

Optionally, the first body can have a tapered shape with a larger outer diameter in first locations that are farther from the second body than a smaller outer diameter in locations that are closer to the second body. The first body and the second body can be different portions of a single additively manufactured body having no seams or interfaces between the first body and the second body. The first body can include one or more internal cutouts or pockets that allow the first body to flex and reduce thermal stress in the first body as the first body thermally expands. The first body and/or the second body can include an internal threaded surface shaped to mate with an outer threaded surface of a sleeve in which the fuel injector is disposed. The first body can include an external threaded surface shaped to mate with an internal threaded surface of the cylinder head.

In one embodiment, the different bodies described in connection with different embodiments or Figures may be combined with each other. For example, the first body 102 can be combined with one or more of the second bodies 108, 908, 1508, 2104 to form an insert device, the first body 902 can be combined with one or more of the second bodies 108, 908, 1508, 2104 to form an insert device, the first body 1502 can be combined with one or more of the second bodies 108, 908, 1508, 2104 to form an insert device, or the first body 2102 can be combined with one or more of the second bodies 108, 908, 1508, 2104 to form an insert device. Optionally, the relative positions of the first and second bodies may be switched. For example, the second body 108 may be in the position of the first body 102 and the first body 102 in the position of the second body 108, the second body 908 can be in the position of the first body 902 and the first body 902 can be in the position of the second body 908, and so on. Additionally, the first body of one embodiment can be combined with the second body of the another embodiment and the positions of the first body and the second body switched with each other.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. An insert device comprising:

a first coupling body shaped to be inserted into a receptacle of a cylinder head of an engine cylinder, the first coupling body having a first internal surface that encircles and extends around a center axis to define a first interior volume of the first coupling body that is shaped to receive a distal tip of a fuel injector; and a second mixing body coupled with the first coupling body and extending around the center axis, the second mixing body having a second internal surface that encircles and extends around the center axis to define a second interior volume of the second mixing body, the second mixing body including conduits that extend through the second mixing body from the second internal surface, the conduits configured to receive fuel output by the fuel injector and air from a combustion chamber of the engine cylinder, combine the fuel with the air into a fuel-air mixture, and direct the fuel-air mixture into the combustion chamber of the engine cylinder, wherein the first coupling body has a first end surface positioned to face the cylinder head and the first coupling body is tapered such that an outer diameter of the first coupling body is larger toward the first end surface than toward the second mixing body.

2. The insert device of claim 1, wherein the first coupling body is shaped to provide an interference fit between the first coupling body and the cylinder head.

3. The insert device of claim 2, wherein the first coupling body is shaped to provide the interference fit with a lower interference pressure between the first coupling body and the cylinder head in second locations toward the combustion chamber than in first locations toward the first end surface.

4. The insert device of claim 1, wherein the first coupling body and the second mixing body are different portions of a single body having no seams or interfaces between the first coupling body and the second mixing body.

5. The insert device of claim 1, wherein the first coupling body includes one or more internal chambers extending into the first coupling body from the first end surface of the first coupling body.

6. The insert device of claim 5, wherein the first coupling body is configured to flex around the one or more internal chambers and reduce thermal stress in the first coupling body as the first coupling body thermally expands.

7. The insert device of claim 1, wherein one or more of the first internal surface or the second internal surface includes a locating flat positioned to mate with a corresponding flat surface of the fuel injector.

8. The insert device of claim 7, wherein the locating flat is positioned relative to the conduits in the second mixing body such that the conduits are aligned with fuel spray holes of the fuel injector while the locating flat is mated with the flat surface of the fuel injector.

9. The insert device of claim 1, wherein one or more of the first coupling body or the second mixing body includes an internal threaded surface shaped to mate with an outer threaded surface of a sleeve in which the fuel injector is disposed.

10. The insert device of claim 1, wherein the first coupling body includes an external threaded surface shaped to mate with an internal threaded surface of the cylinder head.

11. A device comprising:

a first body shaped to mate with a cylinder head receptacle, the first body having an end surface facing a fuel injector and a first internal surface shaped to encircle a center axis and receive a tip of the fuel injector from which fuel is ejected; and a second body integrally formed with the first body, the second body having a second internal surface shaped to encircle the center axis, the second body including conduits extending through the second body from the second internal surface and configured to receive the fuel ejected by the fuel injector, mix the fuel with air into a fuel-air mixture, and direct the fuel-air mixture into an engine cylinder combustion chamber, wherein the first body includes one or more internal chambers extending into the first body from the end surface of the first body, the one or more internal chambers permitting the first body to flex and reduce thermal stress in the first body as the first body thermally expands.

12. The device of claim 11, wherein the first body has a tapered shape such that an outer diameter of the first body is larger in second locations farther from the second body than in first locations closer to the second body.

13. The device of claim 12, wherein the tapered shape of the first body provides an interference fit between the first body and an engine cylinder head with a lower interference pressure between the first body and the engine cylinder head in the second locations than in the first locations.

14. The device of claim 11, wherein the first body and the second body are different portions of a single additively manufactured body having no seams or interfaces between the first body and the second body.

15. An insert device comprising:

a first body shaped to be inserted into a receptacle of a cylinder head of an engine cylinder, the first body having an end surface and a first internal surface that extends around and encircles a center axis, the first internal surface sized to receive a tip of a fuel injector; and a second body coupled with the first body, the second body having a second internal surface that extends around and encircles the center axis, the second body including conduits extending through the second body from the second internal surface, the conduits configured to receive fuel output by the fuel injector, mix the fuel with air drawn into the second body into a fuel-air mixture, and direct the fuel-air mixture into a combustion chamber of the engine cylinder, wherein one or more of the first body or the second body includes an interior flat surface positioned to mate with a corresponding flat portion of the fuel injector to align output of fuel from the fuel injector with the conduits in the second body.

16. The insert device of claim 15, wherein the first body has a tapered shape with a larger outer diameter in first locations that are farther from the second body than a smaller outer diameter in second locations that are closer to the second body.

17. The insert device of claim 15, wherein the first body and the second body are different portions of a single additively manufactured body having no seams or interfaces between the first body and the second body.

18. The insert device of claim 15, wherein the first body has an end surface that faces the fuel injector, the first body including one or more internal cutouts or pockets extending into the first body from the end surface that allow the first body to flex and reduce thermal stress in the first body as the first body thermally expands.

19. The insert device of claim 15, wherein one or more of the first internal surface of the first body or the second internal surface of the second body includes threads shaped to mate with an outer threaded surface of a sleeve in which the fuel injector is disposed.

20. The insert device of claim 15, wherein the first body includes an external threaded surface shaped to mate with an internal threaded surface of the cylinder head.

* * * * *